US005158056A

United States Patent [19]

King

[11] Patent Number: 5,158,056

[45] Date of Patent: Oct. 27, 1992

[54] INTEGRAL MAGNETIC IGNITION PICKUP TRIGGER

[75] Inventor: Raymond King, Collierville, Tenn.

[73] Assignee: Torque Converters, Inc., Ashland, Miss.

[21] Appl. No.: 787,031

[22] Filed: Nov. 4, 1991

[51] Int. Cl.[5] ..... F02P 7/067

[52] U.S. Cl. ..... 123/414; 123/192.2; 123/617

[58] Field of Search ..... 123/149 D, 192.2, 414, 123/612, 617; 73/116, 117.3; 324/207.25

[56] References Cited

U.S. PATENT DOCUMENTS

| | | | |
|---|---|---|---|
| 3,518,978 | 7/1970 | Schmiedel | 123/146.5 R |
| 3,521,611 | 7/1970 | Finch | 123/146.5 A |
| 3,554,179 | 1/1971 | Burson | 123/149 A |
| 3,587,550 | 6/1971 | Zechlin | 123/599 |
| 3,612,023 | 10/1971 | Sohner | 123/149 A |
| 3,875,920 | 4/1975 | Williams | 123/617 |
| 3,923,022 | 12/1975 | Scholl | 123/415 |
| 3,947,710 | 3/1976 | Miyamoto | 123/149 D X |
| 4,098,243 | 7/1978 | Yoshida et al. | 123/416 |
| 4,106,460 | 8/1978 | Kopera | 123/146.5 D |
| 4,428,333 | 1/1984 | Erhard | 123/149 C |
| 4,499,888 | 2/1985 | Hino et al. | 123/615 |
| 4,628,891 | 12/1986 | Asai et al. | 123/149 D X |
| 4,850,323 | 7/1989 | Ricordi | 123/414 |

FOREIGN PATENT DOCUMENTS 2744944 4/1979 Fed. Rep. of Germany .

*Primary Examiner*—Tony M. Argenbright
*Attorney, Agent, or Firm*—DeLio & Associates

[57] ABSTRACT

A trigger system for the ignition system of an internal combustion engine having a crankcase with a rotatable crankshaft includes an aluminum disk-shaped hub for connection to the crankshaft and rotatable therewith on the end opposite the flywheel of the engine. The hub has at least one weight formed into the hub and offset from its center of gravity for balancing and reducing vibration of the engine during operation. A plurality of magnets or other magnetically responsive elements are provided in openings in a flange extending around the periphery of the hub. A stationary sensor is mounted adjacent the hub for detecting impulses from the magnetically responsive elements as the hub rotates and utilizing the impulses to trigger the ignition system.

20 Claims, 2 Drawing Sheets

INTEGRAL MAGNETIC IGNITION PICKUP TRIGGER

BACKGROUND OF THE INVENTION

This invention relates to a trigger for the ignition system of an internal combustion engine and, in particular, to a magnet triggered ignition system for four-stroke engines in racing vehicles.

The prior art discloses various magnet triggered ignition systems which utilize magnet-containing rotors which are ultimately connected to and rotate in unison with the crankshaft of an internal combustion engine. For example, Williams U.S. Pat. No. 3,875,920, Kopera U.S. Pat. No. 4,106,460, Schmiedel U.S. Pat. No. 3,518,978 and Hino et al. U.S. Pat. No. 4,499,888 disclose that the rotors on which the magnets are mounted are located in the distributor. Burson U.S. Pat. No. 3,554,179 and Finch U.S. Pat. No. 3,521,611 disclose the magnet-containing rotors as being incorporated into the flywheel of the engine, while Erhard U.S. Pat. No. 4,428,333 discloses the magnet-containing rotor as being incorporated into the fan of the engine. Other prior art patents do not specify any particular location for the magnet-containing rotor.

Many racing vehicles utilize stock, four-stroke engines which are heavily modified. For instance, these engines may utilize non-stock internal and external components such as crankshafts, cam shafts, etc. Where nonstock, non-counterbalanced crankshafts are installed, such vehicles often employ a counterbalancing hub attached to one end of the crankshaft to dynamically balance the engine and reduce vibration. Typically, this hub is attached to the crankshaft in place of the pulley which normally drives stock engine accessories such as the water pump, alternator, power steering pump, air conditioner compressor, etc., since such accessories are either not used (because of weight considerations) or are not driven by a belt off the engine (because of power consumption). The use of magnet triggered ignition systems is desirable in racing vehicles since it saves weight and increases performance. It has even been known to bolt a rotor plate containing magnets to the balancer hub in order to trigger a sensor in such ignition systems. However, such rotors have had a tendency to "walk", i.e. to change orientation with respect to the crankshaft under repeated use and abuse so that they must be frequently readjusted to keep proper ignition timing. Furthermore, such bolt-on accessories add undesired weight to the engine and car.

Bearing in mind the problems and deficiencies of the prior art, it is therefore an object of the present invention to provide a magnetic ignition pickup trigger which is particularly suitable for the engines of racing vehicles.

It is another object of the present invention to provide an ignition system for racing vehicles which may be easily installed in existing vehicles.

It is a further object of the present invention to provide a magnetic ignition pickup trigger which reduces undesirable weight in the racing vehicle.

It is yet another object of the present invention to provide a magnetic ignition pickup trigger which retains its proper orientation with respect to the crankshaft and timing after repeated useage.

It is a further object of the present invention to provide a magnetic ignition pickup trigger which dynamically balances non-stock racing crankshafts in internal combustion engines.

SUMMARY OF THE INVENTION

The above and other objects, which will be apparent to those skilled in the art, are achieved in the present invention which provides a trigger system for the ignition system of an internal combustion engine having a crankcase with a rotatable crankshaft therein. The trigger system includes a nonferromagnetic disk-shaped hub, preferably made of aluminum, for connection to the crankshaft and rotatable therewith on the end opposite the flywheel of the engine. The hub has at least one attached counterbalancing weight which is preferably formed into the hub and offset from its center of gravity for balancing and reducing vibration of the engine during operation. A plurality of magnetically responsive elements are provided integrally with and about the periphery of the hub. The hub is preferably keyed to the crankshaft end so that it does not change orientation under repeated use.

A stationary sensor is mounted adjacent the hub for detecting impulses from the magnetically responsive elements as the hub rotates and utilizing the impulses to trigger the ignition system. The hub preferably has a flange along its periphery with openings therein, and the magnetically responsive elements are mounted in the openings, facing away from the center of the hub. The magnetically responsive elements may be composed of a ferromagnetic metal and preferably comprise magnets.

DETAILED DESCRIPTION OF THE INVENTION

Reference will be made herein to FIGS. 1–5 of the drawings which depict the preferred embodiment of the present invention in which like numerals refer to like features of the invention.

Figure 1:
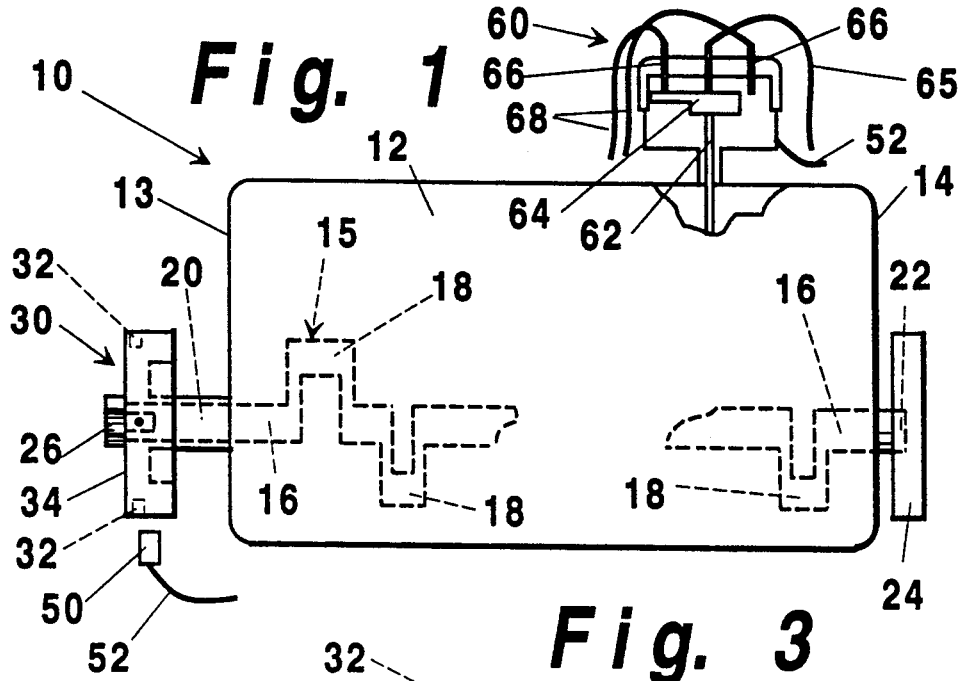
FIG. 1 is a side elevational view of a typical racing engine employing the integral magnetic ignition pickup trigger of the present invention.
Figure 3:
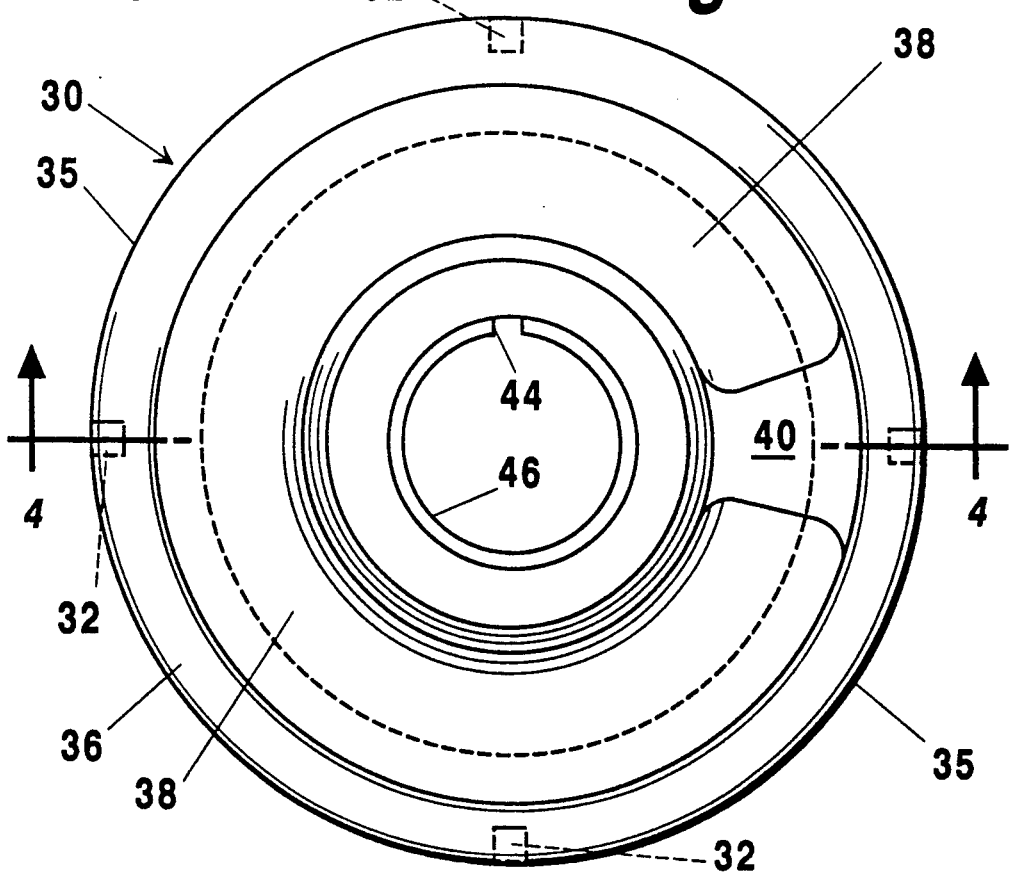
FIG. 3 shows the rear of the embodiment depicted in FIG. 2.
Figure 2:
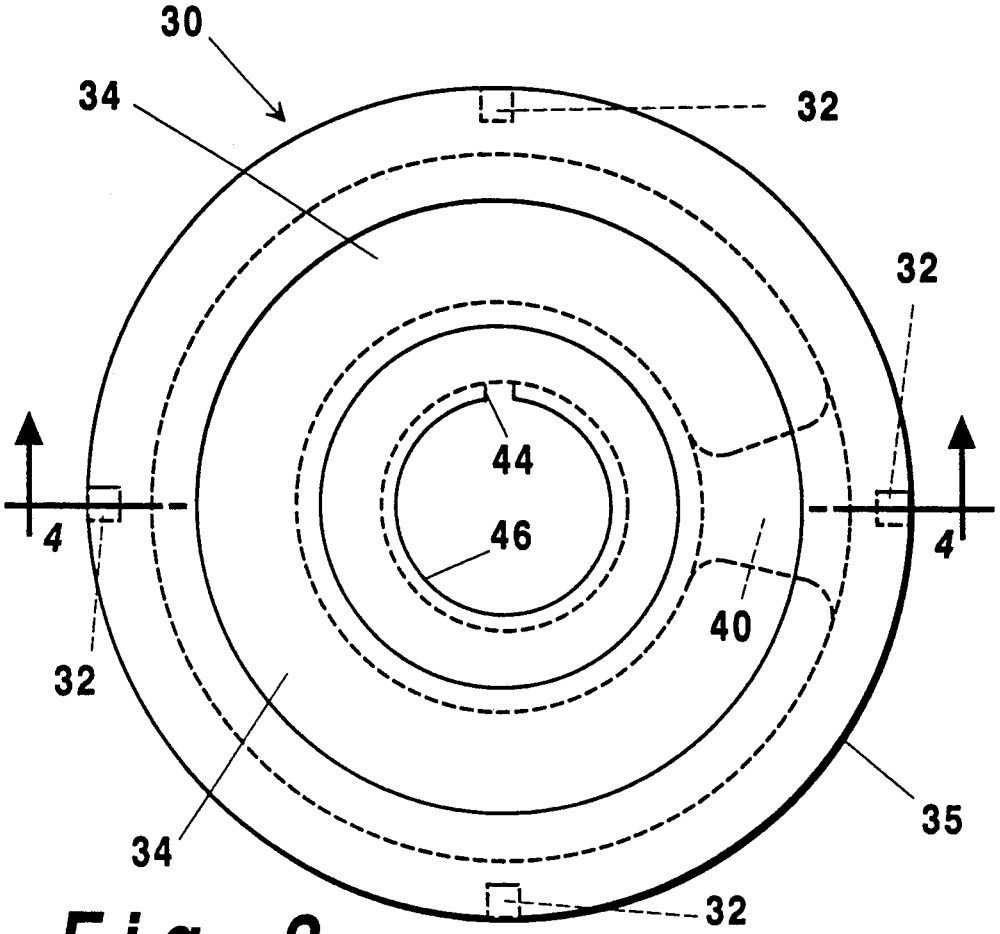
FIG. 2 shows the front of the preferred embodiment of the integral magnetic ignition pickup trigger hub of the present invention.
Figure 4:
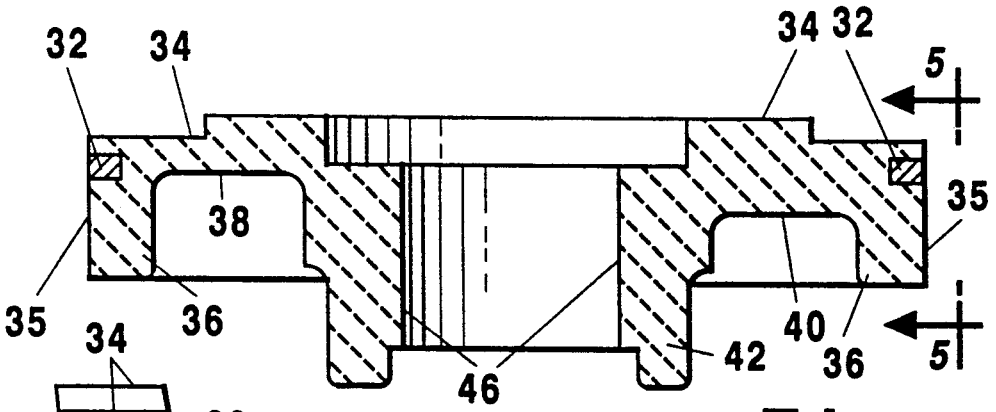
FIG. 4 is a cross sectional elevational view of the embodiment depicted in FIGS. 2 and 3, along line 4—4.
Figure 5:
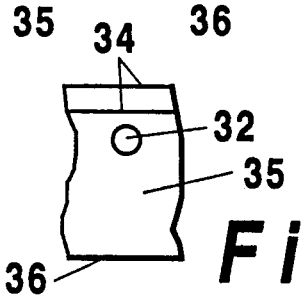
FIG. 5 is a partial side elevational view of the embodiment of FIGS. 2–4 as seen along line 5—5 in FIG. 4.

In FIG. 1 there is shown a side, schematic-type elevational view of a typical four-stroke, eight cylinder racing engine 10 which comprises an engine block or crankcase 12 and internally, a racing crankshaft 15. Crankshaft 15 rotates along shaft sections 16 within crankcase bearings (not shown) and includes throws 18 having bearing surfaces to which the piston rods and pistons (not shown) are connected. As seen in the typical longitudinal orientation of the engine in rear wheel drive vehicles, crankshaft end 22 extends from the rear 14 of the engine and is connected to flywheel 24 and, ultimately, to the clutch/transmission assembly (not shown). At the opposite, front end 13 of engine 10, crankshaft end 20 is connected to hub 30 which incorporates the integral magnetic ignition pickup trigger of the present invention. Hub 30 is positively secured to crankshaft end 20 by bolt 26, and is additionally keyed into the end of the crankshaft so that the hub orientation with respect to the crankshaft remains fixed in use.

To signal the proper commencement of the ignition spark, hub 30 incorporates around its periphery magnetically responsive elements, in this case four timing magnets 32 which are integrally mounted into openings in the hub periphery. During rotation, magnets 32 are sequentially detected by stationary sensor 50 which sends the proper pulse or signal to the ignition system, which then sequentially triggers sparkplugs which ignite the fuel-air mixture in the engine cylinders (not shown). Sensor 50 may be bolted or otherwise secured by conventional means to the front of the crankcase near the hub periphery. The type of circuitry employed in the sensor and ignition system may be of any type normally employed in magnet triggered ignition systems, such as the specific patents listed in the background section of the specification, the disclosures of which are hereby incorporated by reference.

In the preferred embodiment, the signal transmitted over wire 52 constitutes a timing signal which is sent to a distributor 60. The distributor receives the signal and utilizes it to trigger the crank spark which is received from cable 65 and transmitted through distributor shaft 62 to rotor 64 and to the individual sparkplug wires 68 via terminals 66 on the rotor cap.

As seen in more detail in FIGS. 2–5, hub 30 is disk shaped and is preferably machined or otherwise formed from a nonferrous material such as aluminum or other non-magnetic metal alloy. Hub 30 has a sleeve 42 having a central bore or opening 46 which is typically from 0.002 to 0.004 in. less in diameter than the end 20 of crankshaft 15 to provide a proper press fit. Additionally, a key way 44 permits a key to be used to positively fix the hub 30 to the crankshaft 15 without the possibility of rotation of one relative to the other. The front stepped face 34 of the hub extends outwardly to peripheral face 35 which is formed along the outside of flange 36. Uniformly spaced at 90° intervals about the periphery of hub 30 are four (4) one-quarter inch cylindrical magnets 32 which are received within comparable openings to form an integral part of the hub. Any desired type of ferromagnetic material may be employed, for example, steel bolts or plugs, which will create impulses of a metallic shadow which can be picked up by sensor 50 as hub 30 rotates. This clean shadow is possible because the outer portion of the hub is entirely made of a nonferrous material such as aluminum which is thus free of magnetic amplification.

To prevent a non-counterbalanced, racing-type crankshaft from causing excess vibration, there is provided in or on hub 30 a counterbalancing weight 40 which is shown as a wedge-shaped mass which is formed into the hub on its rear face 38 near the periphery. This counterbalancing weight 40, which is offset from the longitudinal axis or center of gravity of hub 30, is manufactured according to known techniques to provide dynamic balancing of the engine during operation to reduce vibration which results from the crankshaft and other moving components of the engine.

The hub is preferably less than about 8 inches in diameter for easy replacement of the existing hub or pulley in the racing engine, and is preferably about 6½ in. in diameter. The present invention provides particular weight savings because it incorporates into a single, integral unit the functions of the magnetic trigger for the ignition timing and the balancer to reduce engine vibration.

Thus, the present invention provides a combination integral magnetic pickup trigger/balancer hub which is useful in racing vehicles and which will not change orientation with respect to the crankshaft at high engine RPMs. Additionally, the combination trigger/balancer hub considerably reduces weight of the engine, compared to separate prior art devices which perform similar functions, and thereby further contributes to enhanced performance. The invention may be optionally used only as a conventional balancer hub, without weight penalty, if it is not desired to use the integral magnets as an ignition trigger.

While this invention has been described with reference to specific embodiments, it will be recognized by those skilled in the art that variations are possible without departing from the spirit and scope of the invention, and that it is intended to cover all changes and modifications of the invention disclosed herein for the purposes of illustration which do not constitute departure from the spirit and scope of the invention.

Having thus described the invention, what is claimed is:

1. A trigger system for the ignition system of an internal combustion engine having a crankcase with a rotatable crankshaft therein, and a flywheel on one end of said crankcase connected to an end of said crankshaft, the trigger system comprising:

a nonferromagnetic disk-shaped hub for connection to said crankshaft and rotatable therewith on the end opposite said flywheel, said hub having at least one attached weight offset from its center of gravity for balancing and reducing vibration of said engine during operation, and, integral therewith, a plurality of magnetically responsive elements about the periphery of the hub; and a stationary sensor mounted adjacent said hub for detecting impulses from said magnetically responsive elements as said hub rotates and utilizing said impulses to trigger said ignition system.

2. The trigger system of claim 1 wherein said weight is formed into said hub.

3. The trigger system of claim 1 wherein said hub has a flange along its periphery, and wherein said magnetically responsive elements are disposed on said flange facing away from the center of the hub.

4. The trigger system of claim 1 wherein said hub has openings along its periphery and wherein said magnetically responsive elements are mounted in said openings.

5. The trigger system of claim 1 wherein said hub is composed of a nonferrous metal.

6. The trigger system of claim 1 wherein said magnetically responsive elements are composed of a ferromagnetic metal.

7. The trigger system of claim 1 wherein said magnetically responsive elements comprise magnets.

8. The trigger system of claim 1 wherein said hub is composed of aluminum.

9. An ignition trigger for attachment to a crankshaft of an internal combustion engine on the end opposite a flywheel comprising a nonferromagnetic disk-shaped hub of diameter less than about 8 inches having a central opening for securing said hub to said crankshaft, at least one individual weight attached near the hub periphery for balancing and reducing vibration of said engine during operation, and, integral therewith, a plurality of magnetically responsive elements about said periphery for inducing impulses in a stationary sensor as said hub rotates and triggering an internal combustion engine ignition system.

10. The device of claim 9 wherein said hub is composed of aluminum and has a flange along its periphery, and wherein said magnetically responsive elements are composed of a ferromagnetic metal and are disposed on said flange facing away from the center of the hub.

11. The device of claim 10 wherein said weight is formed into said hub.

12. The device of claim 9 wherein said hub is composed of a nonferrous metal and has a flange along its periphery, and wherein said magnetically responsive elements comprise magnets disposed on said flange facing away from the center of the hub.

13. The device of claim 12 wherein said weight is formed into said hub.

14. The device of claim 9 wherein said hub has openings along its periphery and wherein said magnetically responsive elements are mounted in said openings.

15. The device of claim 14 wherein said hub is composed of aluminum and has a flange along its periphery, and wherein said magnetically responsive elements comprise magnets disposed on said flange facing away from the center of the hub.

16. The device of claim 15 wherein said weight is formed into said hub.

17. The device of claim 16 wherein said hub has four of said magnetically responsive elements.

18. An internal combustion engine having a crankcase with a rotatable crankshaft therein; a flywheel connected to one end of said crankshaft; an ignition system for said engine; and an ignition trigger including a nonferromagnetic disk-shaped hub key-connected to said crankshaft and rotatable therewith on the end opposite said flywheel, said hub having at least one counterbalancing weight attached at a position offset from the center of gravity for balancing and reducing vibration of said engine during operation, said hub further having integral therewith a plurality of magnetically responsive elements about its periphery, and a sensor mounted on said crankcase adjacent said hub for detecting impulses from said magnetically responsive elements as said hub rotates and utilizing said impulses to trigger said ignition system.

19. The device of claim 9 wherein said hub has a flange along its periphery and is composed of a nonferrous metal, and wherein said magnetically responsive elements are composed of a ferromagnetic metal and are disposed on said flange facing away from the center of the hub.

20. The device of claim 19 wherein said weight is formed into said hub, and wherein said hub has openings along its periphery for receiving said magnetically responsive elements.

* * * * *